United States Patent [19]

Sohl

[11] 4,093,059

[45] June 6, 1978

[54] CHARACTER SLUG CONSTRUCTION

[75] Inventor: Gordon Sohl, Richardson, Tex.

[73] Assignee: Xerox Corporation, Stamford, Conn.

[21] Appl. No.: 747,844

[22] Filed: Dec. 6, 1976

[51] Int. Cl.[2] ..... B41J 1/30

[52] U.S. Cl. ..... 400/144.2; 101/93.17; 400/174

[58] Field of Search ..... 101/93.09, 93.16, 93.17, 101/111; 197/23, 36, 49, 53, 54

[56] References Cited

U.S. PATENT DOCUMENTS

| | | | |
|---|---|---|---|
| 3,442,365 | 5/1969 | Ragland et al. | 197/53 |
| 3,840,105 | 10/1974 | Kittredge | 197/53 |
| 3,848,722 | 11/1974 | Bolan et al. | 197/53 |
| 3,901,371 | 8/1975 | Scott | 197/53 |
| 3,970,186 | 7/1976 | Sohl et al. | 197/54 |

OTHER PUBLICATIONS

IBM Tech. Disclosure Bulletin, R. H. Harrington, et al., vol. 18, No. 2, Jul. 1975, p. 371.

IBM Tech. Disclosure Bulletin, J. H. Meier, et al., vol. 16, No. 6, Nov. 1973, pp. 1689–1692.

*Primary Examiner*—Paul T. Sewell

[57] ABSTRACT

An impact printing element in the shape of a wheel is constructed by molding a thermoplastic character slug onto the tips of metal spokes or beams extending radially outward from a center section. The thermoplastic is bulk filled to give the slugs tolerance to impacting forces produced by an impact hammer for deflecting the slug toward a record medium enabling a print surface on the slug to cooperate in a process for marking the record medium. Each character slug has a front surface with a raised character extending therefrom and a rear surface adapted to be struck by the print hammer for moving the slug in a print operation. Extending from the rear surface of each character slug is a spherical section projection that directly receives the strike from the print hammer. The projection is a spherical section positioned at the centroid of the raised character.

4 Claims, 10 Drawing Figures

CHARACTER SLUG CONSTRUCTION

BACKGROUND OF THE INVENTION

This invention relates to impact printers, and more particularly to a character slug for impact printers providing more uniform print quality.

Impact printers receive their name from the use of hammers or the like to impact a slug against an ink carrier and a record medium—usually twenty-pound bond paper—backed by a platen. The platen is the anvil for the hammer's blow. The ink carrier is conventionally a ribbon, i.e., an elongated web impregnated with ink. The ink is transferred to the paper record medium when the two are brought into intimate contact under the blow of the hammer. Ink is released from the ribbon is raised character areas on the slugs corresponding to the shape of a character. Broadly, a serial impact printer is one in which a line of print is inscribed one character at a time. Classic examples of serial printers are the familiar office typewriter, teletypewriter printers and low speed computer output printers. Other classic impact printers include calculating machines such as adding machines and business accounting machines which use mostly numerical characters.

Printing elements for serial printers shaped generally in the form of a wheel or the like have been known for some time. By way of example, see U.S. Pat. Nos. 2,236,663 (1941), 3,461,235, 3,498,439 and 3,651,916. Presently there is marketed a serial printer which has a print wheel having a plurality of slugs located at the ends of spokes or beams extending radially outward from a hub. The print wheel is rotated by a servo mechanism to position selected characters opposite a hammer and ribbon at a printing station. This type of printer has enjoyed commercial success as an electronic printer capable of high speed and versatile operation. The print wheel it employs is basically a single element structure in that the beams and slugs are an integrally molded thermoplastic structure. This print wheel delivers superior performance with very favorable economics, i,e., the integral wheel is relatively inexpensive to manufacture. Nonetheless, when subjective standards of print quality are encountered in certain application, the integral-structure print wheel heretofore available does not always give the desired print quality.

In automatic text editing typewriter applications the demands on a print wheel are greater than in an electronic printer. In the text editing or office typing environment, the demands for high print quality cause the print wheel to be subjected to about ten times greater force due to about five times greater hammer energy compared to a printer operating as a computer output terminal, for example. Text editing machines include a printer, a keyboard and an electronic controller having some form of memory or storage. A typist enters character information into the memory and/or creates a copy on the typewriter printer at from 0.5 to 2.0 characters per second (cps). The typed information is manipulated by the electronics to correct errors and arrange format, and an edited document is automatically typed by the printer under control of the electronics at speeds upward of 15 cps. Clearly, in this environment, the print wheel is asked to perform in manual and automatic modes which are distinct if for no other reason than on basis of speed. Of course, the user generally expects like print quality whether the machine is operated at a 2 or 20 cps rate.

A plastic, integral print wheel performs satisfactorily in both the low and high speed and energy modes mentioned above but not with the same print or image quality over the same life span. Loss in image quality is generally judged as the first fall off in image resolution detectible by the unaided eye. The improved print wheel of this invention, on the other hand, performs excellently over even a broader range of operating conditions than those mentioned above.

Print wheels when used in either an electronic printer or an automatic text editing typewriter must be accurately positioned such that the blow of the hammer drives the character against the record medium uniformly over the character area. This requires close dimensional tolerances from the position of the hub or center section of the print wheel to the hammer, all in relationship to the platen; especially for asymmetrical character configurations where the hammer strikes the slug away from the centroid of the character. With regard to asymmetrical characters, one part of the character strikes the record medium unevenly resulting in poor print quality. In some applications of the electronic printer, where print quality is not as critical, this degradation of print quality may be acceptable. However, in the automatic text editing typewriter better print quality is required. To achieve high quality printing in the automatic text editing typewriter, each character of the print wheel is subjected to the greater impact forces to ensure that the entire character area uniformly contacts the record medium.

SUMMARY OF THE INVENTION

In accordance with the present invention, each character slug is driven in a manner to uniformly contact the record medium for improved print quality. Forces produced by the hammer against the character slug are uniformly distributed to drive the character against the record medium. With the character slug of the present invention the dimensional tolerances for the position of the print wheel with respect to the hammer and platen are relaxed.

A print element in accordance with the present invention includes an insert member having a plurality of beams extending outwardly from a base section. Character slugs are coupled to the ends of the beams and each character slug includes a front surface having a raised character extending therefrom and a rear surface adapted to be struck by an impacting hammer for deflecting the slug toward a record medium enabling a print surface on the slug to cooperate in a process for marking the record medium. The rear surface of each slug includes a projection extending therefrom to directly receive the strike from the impacting hammer.

Specifically, a character slug in accordance with the present invention is coupled to the end of a beam extending from the base of a print element for an impact printer. The character slug includes a front surface having a raised character extending therefrom and a rear surface adapted to be struck by an impacting hammer for moving the slug in a print operation. The rear surface of the character slug includes a spherical section projection extending therefrom to directly receive the strike from the impacting hammer. The spherical section of the character slug is located on the back surface at the centroid of the raised character.

BRIEF DESCRIPTION OF THE DRAWING

A more complete understanding of the invention and its advantages will be apparent from the following detailed description taken in conjunction with the attached drawings.

Referring to the drawings.

DESCRIPTION OF THE PREFERRED EMBODIMENT

Figure 1:
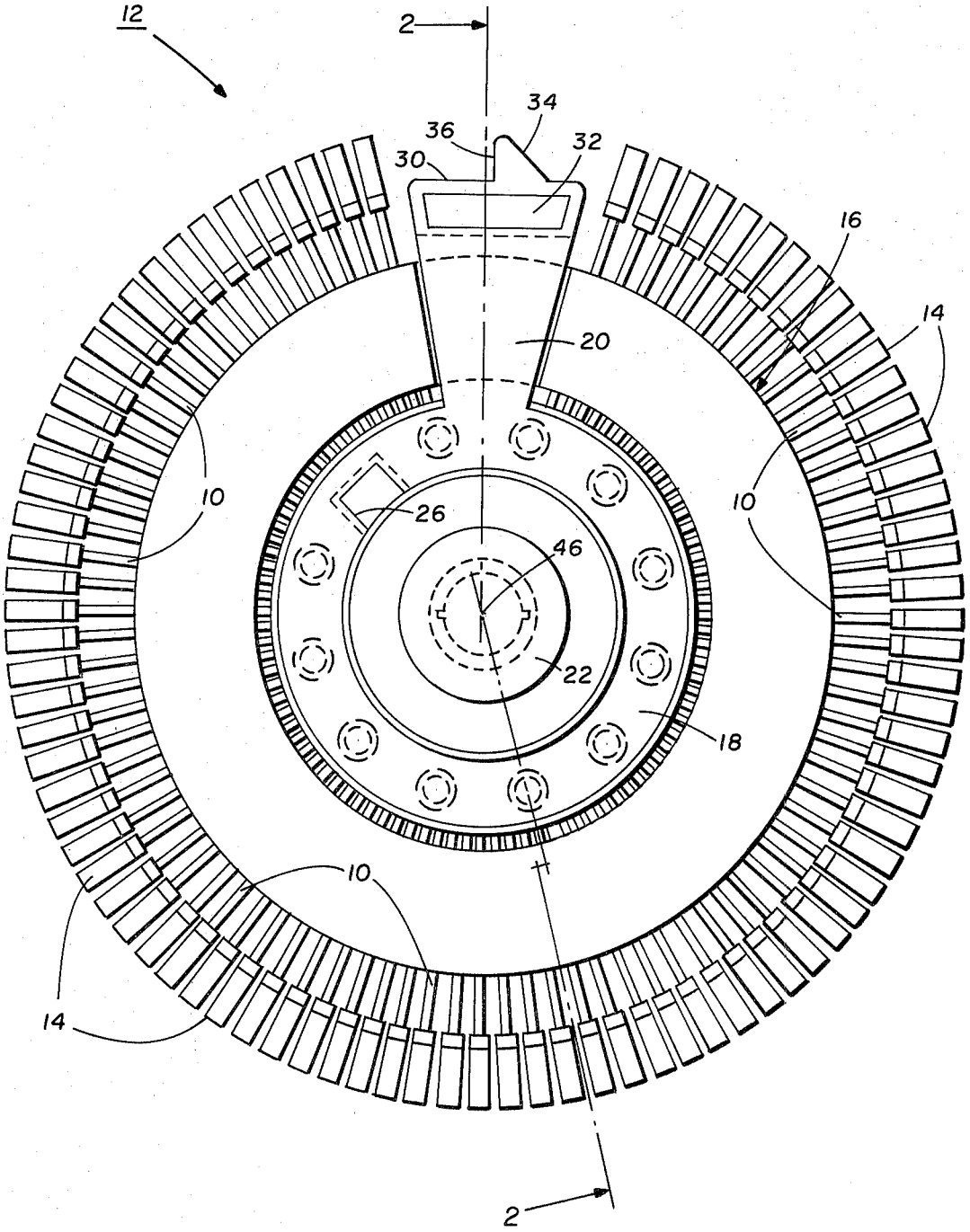
FIG. 1 is a plan view of a composite print wheel carrying character slugs of the present invention.

Referring to FIG. 1, there is shown a character slug of the present invention molded onto the ends of the spokes of beams 10 of a print element or wheel 12 which is a composite structure being made up of several components, the most prominant of which are the character slugs 14. Other components of the print element 12 include a damper 16 mounted over the beams to alter the deflection properties, and a hub 18 riveted to the center of the wheel with a flag 20 extending radially outward from the hub. A cap 22 for assembling the wheel into a print machine is attached to the hub 18 at the core of the wheel.

Figure 2:
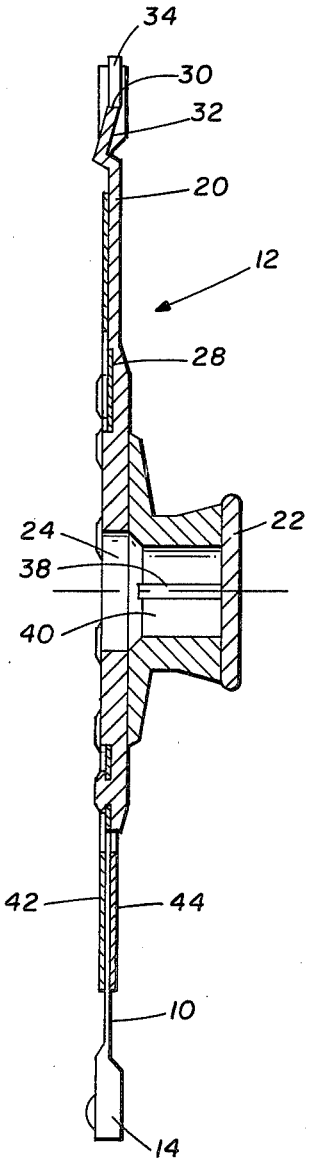
FIG. 2 is a sectional elevation view of the composite print wheel in FIG. 1 taken along the lines 2—2.

Referring to FIG. 2, the hub 18 has a circular configuration with an opening 24 at the center thereof to permit attachment of the wheel 12 to a shaft on a printer for rotating each of the character slugs into a print position during a printing operation. The alignment of the print element to the shaft of a printer is provided by a keyway or square notch 26 fabricated to establish within desired tolerances the angular position of each character slug 14 and the flag 20 with respect to the shaft. Typically, the hub 18 is a thermoplastic material formed with a plurality of rivets protruding perpendicular therefrom in the molding process. The rivets fit through mating holes in an insert member 28 from which the beams 10 extend.

The flag 20 is integral with the hub 18 being fabricated therewith in a molding process. As shown in FIG. 1, the flag is a truncated pie-shaped section whose width increases with radii and the outer end of the flag includes a straight edge 30 which serves as an underline of characters being printed. The slope surface 32 faces an operator, that is, the surface on the impact side of the wheel is angled from the plane of the wheel and visually emphasizes the straight edge and is a convenient location for a label to identify the wheel as an operator aid. At the very end of the flag is a pointer 34 which is a vertical reference mark to help the user visually align the eye to the printing position. The vertical surface 36 and straight edge 30 form a "cross-hair" for locating characters in a line of print. The single pointer appears to the left of the last character and the user mentally brackets the character.

The cap 22 at the center of the wheel 12 serves to help attach the wheel to a shaft in a print mechanism. The cap 22 is adhesively bonded to the hub 18 opposite the printing side of the print wheel. A slot or key 38 is cut into the side surface of a cylindrical passage 40 of the cap 22.

As shown in FIG. 2, the damper 16 comprises two circular shaped rings 42 and 44, with the ring 42 located on the impact side of the wheel and the ring 44 located on the printing side of the wheel. The rings are constructed from a fabric and are adhesively bonded to the beams 10 and to each other in the region between the beams. The rings 42 and 44 are aligned concentric with the axis 46 of rotation of the wheel 12 which is normal to the plane of the drawing of FIG. 1. Dimensionally, the rings are designed so that they are adhesively attached only to the beams and do not extend into the area of the hub 18 or outwardly to the slugs 14.

Functionally, the rings alter the deflection properties of the beams 10 by reducing the vibration amplitude and duration of the beams for a given deflection of a beam tip from a common plane shared by the beams. The rings 42 and 44 lie across adjacent beams and the deflection of one is passed to its adjacent neighbor to some degree. Thus, the damper 16, comprising the rings 42 and 44 controls the maximum rebound amplitude of each character slug by mechanically limiting it.

For a more detailed description of the print wheel 12, reference is made to the copending patent application of Gordan Sohl et al, Ser. No. 683,977, filed May 6, 1976, entitled "Composite Print Wheel."

Figure 3:
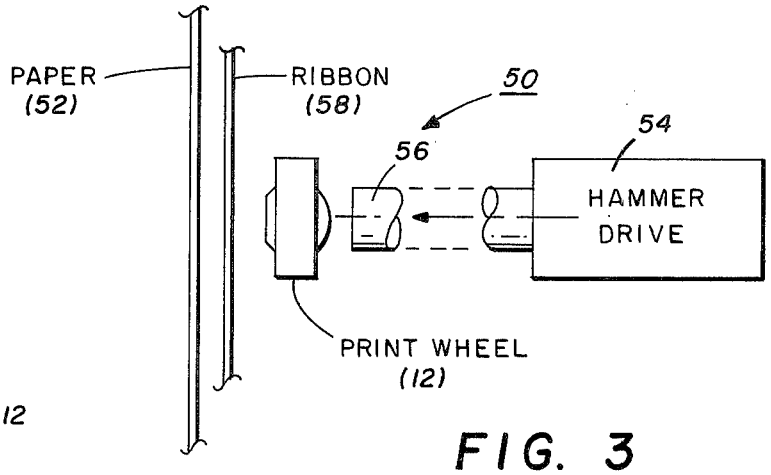
FIG. 3 is a simplified schematic view of a hammer type impact printing mechanism for driving the character slugs of the present invention against a record medium.

Referring to FIG. 3, there is schematically shown in hammer type impact printing mechanism 50 for printing on a plain paper recording medium 52. To that end, the printing mechanism 50 comprises a driver 54 for propelling a hammer 56 forwardly, thereby urging a character slug 14 of the print wheel 12 into engagement with an inked ribbon 58 which, in turn, strikes the paper 52 to print a replica of the character.

The printing mechanism 50 further includes a platen (not shown) for supporting the recording medium 52. The driver 54, the hammer 56, the character wheel 12, and the ribbon 58 are carried by a carriage (also not shown) which is mounted for linear movement transversely of the platen. The exemplary printing mechanism is essentially identical to one that is now in use in a commercially available electronic typewriter. Consequently, a more detailed description of the printing mechanism may be had by reference to commercially available equipment and to the published literature pertaining thereto.

Figure 5:
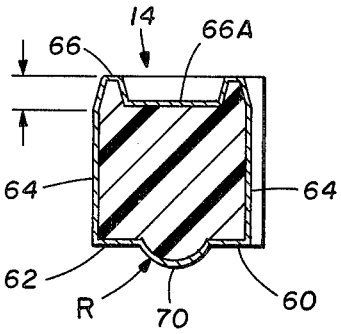
FIG. 5 is an elevational sectional view of the character of FIG. 4 taken along the lines 5—5.
Figure 4:
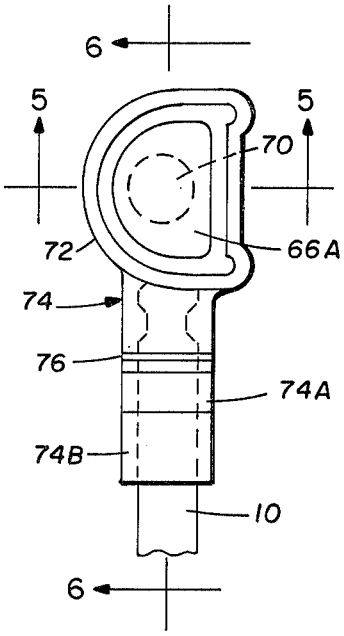
FIG. 4 is a plan view of a character slug showing the position of an extending projection at the character centroid.
Figure 6:
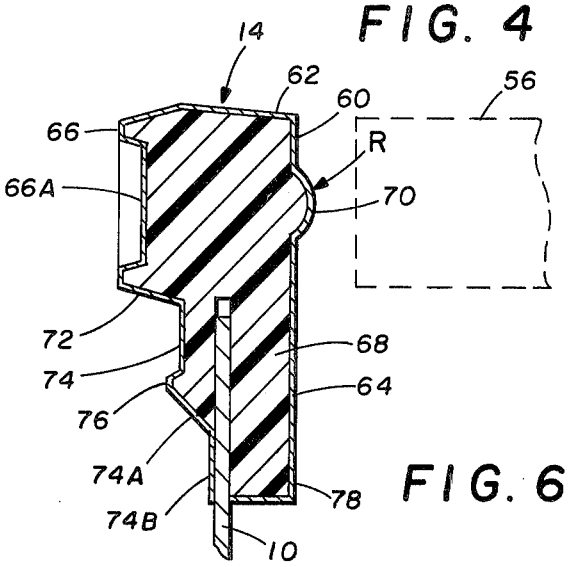
FIG. 6 is an enlarged side sectional view illustrating a typical character slug with a spherical section projection extending from the back surface.

Referring to FIGS. 4–6, the details of a character slug are illustratd in more detail to emphasize the present invention and the advantages thereof when used with a printing mechanism of the type shown in FIG. 3. The character "D" (capital d) is selected as typifying the structure of other character slug structures. For the present wheel, there are 88 characters defining a font suitable for most English language document creation requirements. A 92 spoke wheel is used for other language applications. The font includes upper and lower case characters, numbers, punctuation marks and other useful symbols. The number of characters in a font is often influenced by the binary or other digitalized coding representation used by the electronics associated with the impact printer using the wheel. For document creation purposes, a five binary bit code is required to at least include the English alphabet in the font since it yields 32 bit combinations. More practically speaking, a six bit code with its 64 bit combinations is more useful since both upper and lower case and punctuation marks can be encompassed within a 64 character font. The present 88 character wheel requires a seven bit code but obviously the capacity of the font is not strained by reason of a shortage of available binary bit combinations to represent the characters in the font. The unused bit representations are assignable to "space", carriage return and other functional commands. The printer mentioned earlier presently employs a print wheel having 96 character slugs dispersed about the wheel.

The slugs are molded onto the tip of the beams using a bulk 60 filled polymer 62 material and thereafter are plated by suitable processes with a metallic wear resistant coating 64. The mold, of course, shapes the entire slug including the printing surface 66 (in this case the letter "D") and the impact surface 68 including the spherical section projection 70 for providing more uniform print quality in accordance with the present invention. The printing surface is the raised portion comprising the shape of the letter "D" which in a typewriter like printer causes the ink from the ribbon 58 to be transferred to the recording medium 52 in a corresponding letter "D" shape under the blow of the hammer 56 delivered to the slug through the protrusion 70 on the impact surface 68.

The impact surface is that beyond the tip of the beam. The definition divides the slug into two principal portions being the printing section 72 lying mostly under the letter "D" or other character and the capture section 74 surrounding the tip of a beam 10. With this division or separation of the printing section from the capture section the joint between slug and beam is protected from the stresses set up in the slug under the forces transmitted to the slug during a printing process. The primary force acting on the slug is that due to compression between a hammer and a platen.

Every character slug has a bench mark 76 for referencing the character on the slug relative to the rotational center of the print wheel. The relative position between the bench mark and the character is known so the bench mark is used for reference rather than the character because of the easier implementation. The bench mark is located on the slug at a position on a shorter or equal radius to that for the lowest positioned character in the font--normally the "underline" character.

The capture portion 74 of the slug includes a rebound surface 78 which lies below the impact surface 68 so as to abut against a backstop or bumper which includes a rigidly mounted member for limiting mechanically the distance the beam and slug are able to deflect on rebound. The thickness of the slug is selected not merely to impart strength and durability but also to yield an offset from the beam 10. The offset enables the bumper or backstop mechanism to be physically closer to the wheel.

The capture section 74 of the slug also includes the beveled region defined by the sloped surface 74A and the plane surface 74B. The beveled region shortens the dimension of surface 66A underlying the printing surface 66 so as to minimize the possibility of interference with the ribbon or other apparatus between it and a platen. Also, in the molding process, the flashing operation is enhanced by reason of this shape among other benefits.

The significant feature of the composite slug and beam structure of this invention is the spherical section projection 70 extending rearwardly from the impact surface 68. This projection 70 is located at the centroid of the character to evenly distribute the force generated by the hammer 56 to the surface of the character when driven against the platen. The problem has been that the character slug is not constrained in its alignment resulting in additional printing from other parts of the slug, distortion in the print quality caused by vertical motion of the slug, and beam breakage caused by excessive stress. The protrusion 70, by distributing the impact forces from the hammer 56 over the printing area, reduces alignment sensitivity.

The radius of the protrusion 70 can be calculated from the following expression:

$$R = (T)(SD)/\sin\theta, \qquad (1)$$

where T equals the alignment tolerance of the impact point of the hammer 56 against the impact surface 68, SD equals the dimension of the character on the slug, and $\sin\theta$ is the alignment error.

Typically, assuming a $\pm 2°$ alignment error, 5% alignment tolerance, and a dimension of the character of 0.050 inches, the radius of the projection 70 is:

$$R = 0.5 \times .050 \text{ inches}/\sin 2°$$
$$= 2.5 \times 10^{-3}/3.5 \times 10^{-2}$$
$$= 0.0714 \text{ inches.}$$

The character "D" of FIGS. 4–6 typifies the alphanumeric characters of a standard print wheel. Also included on the print wheel are punctuation marks that must be uniformly driven against the paper 52 for high quality printing. Referring to FIGS. 7–10, the details of the character slug for the "dash" and the "apostrophe" are illustrated. These two character slugs typify characters that have a centroid intentionally displaced from the center line of the print hammer 56. Thus, even when there is an alignment between the character slug and the print hammer distortion of the print quality results and increased stress is placed on the beam 10.

With reference to the "dash", the printing surface 80 is raised portion outlining the shape of the "dash" compared to the letter "D" printing surface of FIGS. 4–6. Again, the slug is divided into two principal portions including the printing section 82 and the capture section 84, the latter surrounding the tip of a beam 10. An impact surface 86, or rear surface, includes a spherical section projection 88 positioned at the centroid of the "dash" opposite from the raised portion 80.

Note that for the letter "D" the projection 70 is located at a position near the center line of the hammer 56. This results because the centroid of the letter "D" is approximately halfway between the upper and lower portions of the printing surface as illustrated in FIG. 6. With regard to the "dash", the projection 88 is displaced below the center line of the print hammer 56 and impacting forces from the print hammer drive the character slug into the paper 52 such that the upper and lower parts of the surface 80A do not contact the paper 52 in the printing operation.

Figure 8:
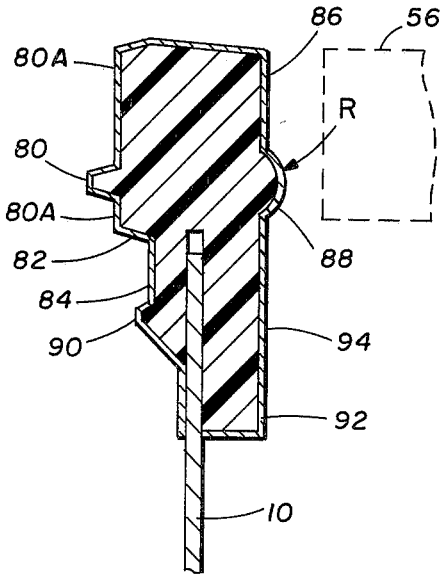
FIG. 8 is an enlarged side sectional view illustrating the "dash" character of FIG. 7 and the spherical section projecting from the rear surface and taken along the line 8—8.
Figure 7:
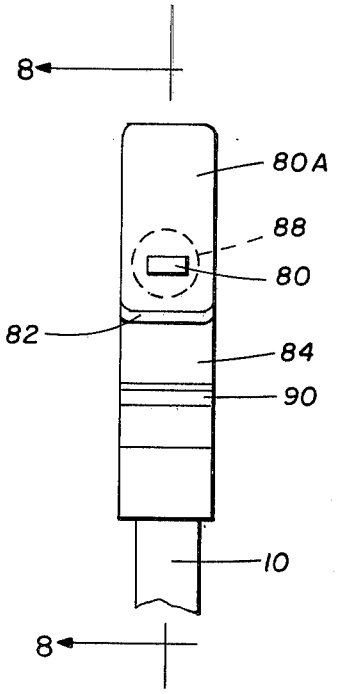
FIG. 7 is a plan view of a character slug for a "dash" showing the position of the extending projection.

The character slug of FIGS. 7 and 8 includes a bench mark 90 and is dimensioned like the slug of FIGS. 4–6 to impart strength and durability and includes a rebound surface 92 to abut againt a backstop or bumper. The entire slug including the printing surface 80 is plated with a metallic wear resistant coating 94. This metallic coating enhances the resistance to abrasive wear of a printing surface 80. The plating also increases wear resistance of a projection 88 thus the impact forces generated by the hammer 56.

Figure 10:
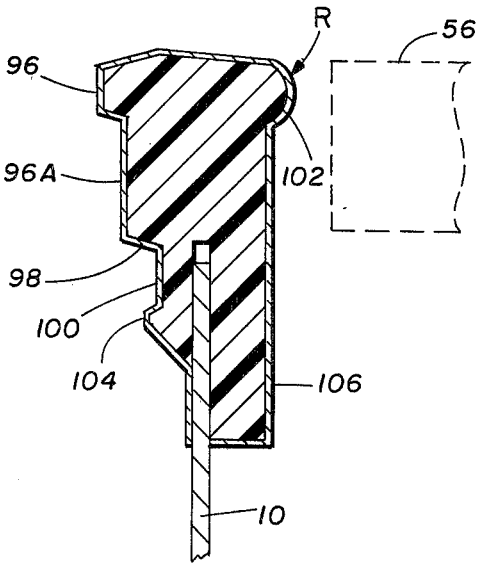
FIG. 10 is an enlarged side sectional view illustrating the "apostrophe" character slug and the spherical section extending from the rear surface thereof and taken along the line 10—10.
Figure 9:
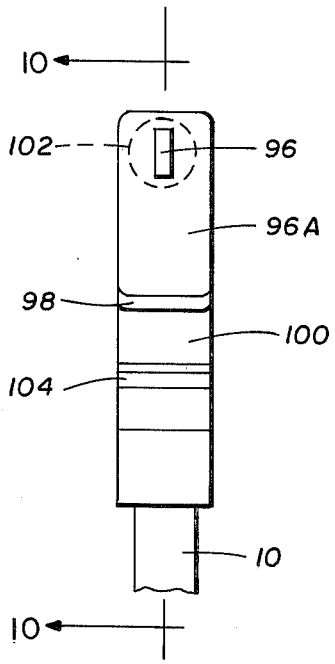
FIG. 9 is a plan view of a character slug for the "apostrophe" and the position of the extending projection.

Referring to FIGS. 9 and 10, there is shown the "apostrophe" punctuation mark, another special character slug. The printing surface 96 is positioned toward the upper portion of a printing section 98 extends from the front surface 96A. The printing section 98 is integral with the capture section 100 surrounding the tip of a beam 10.

Formed with the molding of a character slug for the "apostrophe" is a spherical section projection 102 positioned at the centroid of the printing surface 96. Again, as in the case of the "dash" character slug, the projection 102 is offset such that when directly contacted by the print hammer 56 it is off center from the print hammer center line. Impacting the projection 102 with the print hammer 56 drives the raised surface 96 against the paper 52 and positioned the entire slug with respect to the paper to minimize or eliminate all contact of the surface 96A with the paper 52.

A bench mark 104 is formed in the character slug at the capture portion 100. Again, the entire character slug is plated by a suitable process with a metallic wear resistant coating 106.

The projections 88 and 102 of the character slugs of FIGS. 7–10 are dimensioned in accordance with expression (1), previously discussed with regard to FIGS. 4–6. Assuming the same degree of misalignment and tolerance error for the impact point of the hammer 56, only the dimension of the type slug face will change. This will slightly modify the radius of the spherical section projections 88 and 102 from the calculations previously given with regard to the projection 70.

While only one embodiment of the invention, together with modifications thereof, has been described in detail herein and shown in the accompanying drawings, it will be evident that various further modifications are possible without departing from the scope of the invention.

What is claimed is:

1. A character slug coupled to the end of a beam extending from the base of a print element for an impact printer, comprising:

a front surface having a raised character extending therefrom, and a rear surface engageable by an impacting means for moving the slug in a print operation, said rear surface including a projection extending therefrom to directly receive the strike from the impacting means and uniformly distribute impact forces therefrom over the character area, said projection positioned on the rear surface at the centroid of the raised character and having a substantially spherical configuration with an area substantially less than the strike area of the impacting means.

2. A character slug as set forth in claim 1 wherein the radius of the spherical projection is determined by the expression $R = (T)(SD)/\sin\theta$, where $\theta$ is the angle of misalignment between the impacting means and the character slug, T equals an alignment tolerance, and SD equals the dimension of the raised character.

3. A print element for an impact printer, comprising:

an insert member having a plurality of beams extending outward from a base section, and character slugs coupled to the ends of the beams, each character slug including:

a front surface having a raised character extending therefrom, and a rear surface engageable by an impacting means for deflecting the slug toward a record medium enabling the character on the slug to cooperate in a process for marking the record medium, said rear surface including a projection extending therefrom to directly receive the strike from the impacting means and uniformly distribute impact forces therefrom over the character area, said projection positioned on the rear surface at the centroid of the raised character and having a substantially spherical configuration with an area substantially less than the strike area of the impacting means.

4. A print element for an impact printer as set forth in claim 3 wherein the radius of the spherical projection is determined by the expression $R = (T)(SD)/\sin\theta$, where $\theta$ is the angle of misalignment between the impacting means and the character slug, T equals an alignment tolerance, and SD equals the dimension of the raised character.

* * * * *

UNITED STATES PATENT AND TRADEMARK OFFICE

CERTIFICATE OF CORRECTION

PATENT NO. : 4,093,059

DATED : June 6, 1978

INVENTOR(S) : Gordon Sohl

It is certified that error appears in the above-identified patent and that said Letters Patent are hereby corrected as shown below:

Column 6, change line 41 to read as follows:

R = .05 X .050 inches/sin 2°

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*